United States Patent [19]

Sutliff et al.

[11] 4,186,807

[45] Feb. 5, 1980

[54] OPTIONAL UP-BLOW, DOWN-BLOW JAR TOOL

[76] Inventors: Wayne N. Sutliff; Jim L. Downen, both of 2931 Pierce Rd., Bakersfield, Calif. 93308

[21] Appl. No.: 862,487

[22] Filed: Dec. 20, 1977

[51] Int. Cl.[2] ..... E21B 1/10

[52] U.S. Cl. ..... 175/302; 175/300; 175/304; 166/178

[58] Field of Search ..... 175/293, 296, 297, 299, 175/300, 302, 304, 306; 166/178, 237

[56] References Cited

U.S. PATENT DOCUMENTS

| | | | |
|---|---|---|---|
| 1,885,043 | 10/1932 | Beck | 175/304 X |
| 2,241,477 | 5/1941 | Rasmussen | 175/304 X |
| 3,685,598 | 8/1972 | Nutter | 175/304 X |
| 3,853,187 | 12/1974 | Sutliff et al. | 175/304 X |

*Primary Examiner*—Ernest R. Purser
*Assistant Examiner*—Nick A. Nichols, Jr.
*Attorney, Agent, or Firm*—Dana E. Keech

[57] ABSTRACT

An improvement on the tool shown in U.S. Pat. No. 3,853,187, this tool also embodies in a single structure inner and outer telescopically related tubular elements confining a body of operating liquid and comprising a hydraulically retarded up-blow jar, actuated by placing a lifting strain on the drill string, and a simple mechanically retarded down-blow jar actuated optionally by a controlled downward pressure of the drill string on the jar. This jar differs from the patented jar by inverting said structure and actuating said two jar mechanisms respectively by upward and downward movements of said inner element. It also embraces improved specific control devices for said up-blow and down-blow jar mechanisms.

6 Claims, 21 Drawing Figures

121
120
119
25
116
27
125
118
117
78
73
26
65
64
16
16
74
61;62
61;62
60
72
63
59
71
70
57
78
26
126
115
110
109
48
58
77
79
56
50
49
55
17
47
26
130
77
45
18
44
105
103
104
107
46
102
101
108
100
18
79
46
80
81
83
84
76
40
91
41
17
42
82
35
86
26
76
31
34
32
33
28
29
30

OPTIONAL UP-BLOW, DOWN-BLOW JAR TOOL

SUMMARY OF THE INVENTION

Among the objects sought to be attained are the provisions of such a jar tool having a high degree of reliability in performance of the downward telescopic contraction control mechanism of the jar; to invest said mechanism with adjustability permitting it to be pre-set to determine precisely the amount of downward pressure from the drill string which will be required to initiate in said tool the delivery by said tool of a downward snap-action jarring blow; and to materially dissipate interference with said down-blow delivering operation of said jar by the automatic concurrent resetting of the hydraulic control means employed in the delivery of an upward jarring blow by said tool.

DETAILED DESCRIPTION OF THE PREFERRED EMBODIMENT

Figures 1, 2, 3, 4, 5:
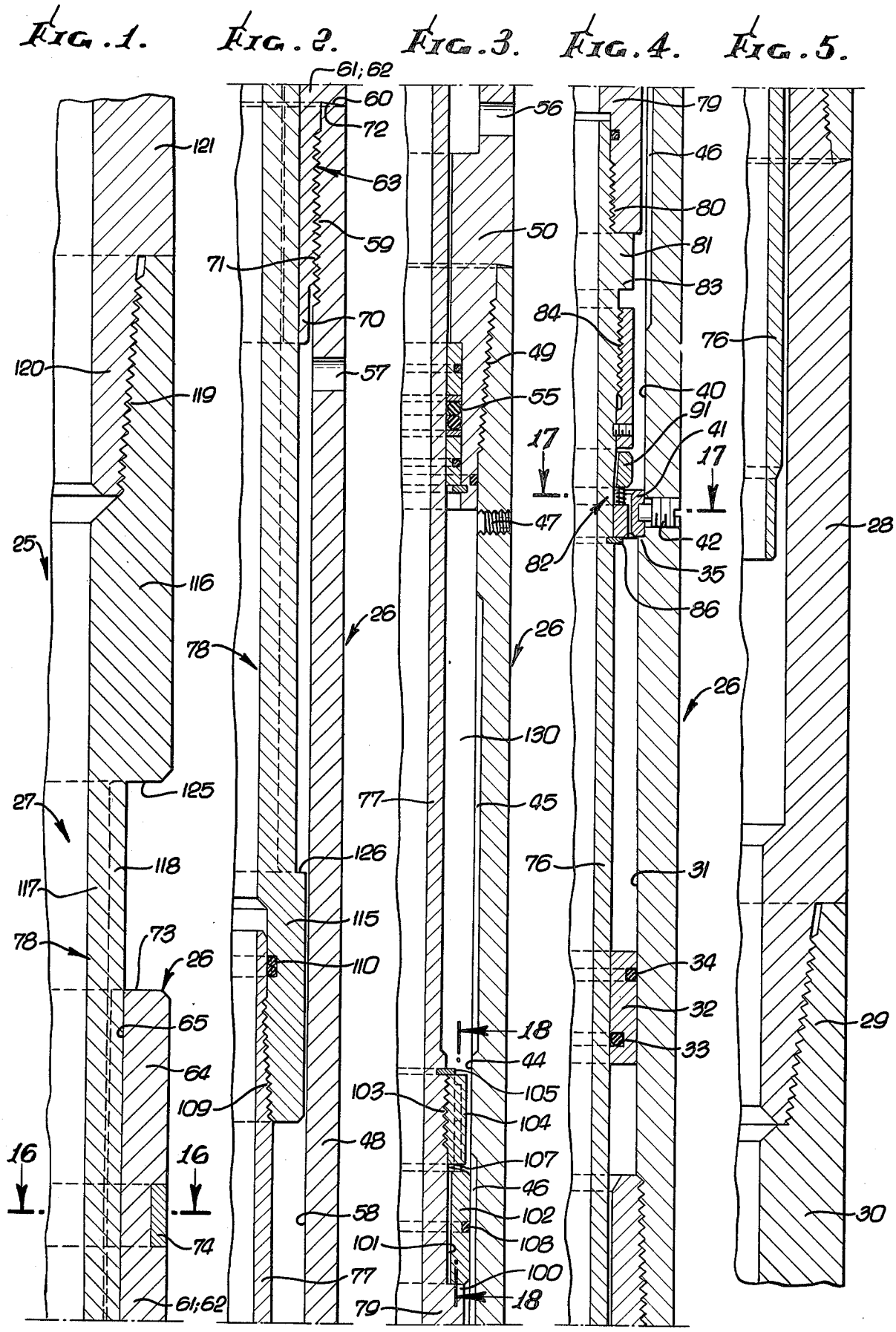
FIGS. 1 to 5 inclusive are vertical half-sectional views of successive portions of a preferred embodiment of the invention which, taken together, illustrate the parts of the latter disposed in starting position as when beginning an upward or downward jarring operation.

Referring specifically to the drawings, the invention is shown therein as embodied in an optional up-blow, down-blow jar tool 25 which includes an outer tubular element 26 and an inner tubular element 27 which are telescopically related to each other for relative axial movement in the operation of the jar. As shown in FIGS. 1 to 5 inclusive, the tubular element 26 forms a sleeve which houses the jar and is internally threaded at its lower end so as to screw onto a lower jar sub 28 which in turn is adapted to screw onto the upper box end 29 of a fish 30 suspended on said jar.

The outer tubular element 26 has an inner bore 31 which slidably contains therein a lower packing member 32 which is recessed for holding an internal O-ring 33 and an external O-ring 34. The upper end of bore 31 terminates with a shoulder 35 located at the lower end of a counter bore 40. A tripping ring 41 fits within the counter bore 40 against the shoulder 35 and is secured in place by screws 42 which are screwed into suitable tapped holes provided in outer tubular member 26 and fit into suitable recesses provided in the periphery of the ring 41. The ring 41 has a substantially cylindrical internal face which is bevelled at its upper and lower edges at angles of approximately 5° from the axis of the jar.

The counter bore 40 presents a smooth cylindrical surface in a short annular area 44 (see FIG. 3) which will be referred to hereinafter as the "cylinder" of the jar 25. Immediately above and below the cylinder 44, the counter bore 40 is relieved by vertical channels 45 and 46 for a purpose to be made clear hereinafter. One or more suitable tapped holes are provided in the outer tubular element 26 of the jar for use in admitting operating liquid thereto, these holes being closed by filler plugs 47.

Figure 16:
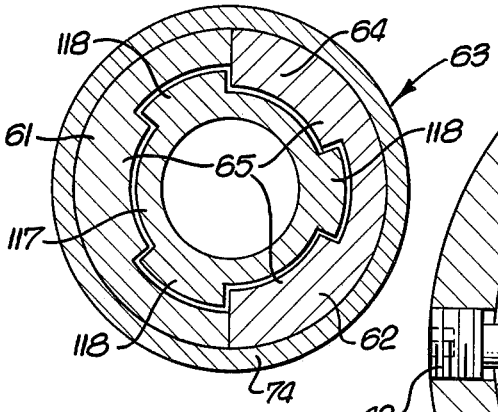
FIG. 16 is a full cross sectional view taken on the line 16—16 of FIG. 1 and illustrates the internal construction of the female spline sub of the invention which is split into two halves.

The upper end portion 48 of the outer tubular element 26 (hereinafter referred to as the stabilizer sleeve) is secured to said element by heavy tapered threads 49, the male threads of which are formed on a heavy annular internal head 50 provided on the lower end of said sleeve 48. Provided on the head 50 to extend inwardly therefrom is a packer 55. Provided in sleeve 48 for a purpose to be made clear hereinafter are rather ample fluid ports 56 and 57. Stabilizer sleeve 48 has a smooth internal bore 58 and an upper end portion thereof is provided with heavy female internal threads 59. The upper extremity of stabilizer sleeve 48 has a male taper 60 of about 20°. The threads 59 constitute one of the means for assembly of the two halves 61 and 62 of a female spline sub 63. The two halves 61 and 62 of female spline sub 63 are brought together face to face to form said complete sub and so as to provide thereon a heavy cylindrical tubular body 64 which is machined internally to provide three female splines 65 and is turned down at its lower end to provide an annular hammer 70 and male threads 71 (matching female threads 59) and a female taper 72 matching the male taper 60 on stabilizer sleeve 48. The opposite or upper end 73 of the female spline sub body 64 provides an upper annular anvil impact face. The body 64 also receives an integral reinforcing ring 74 which may be swedged, welded or otherwise secured in place in uniting relation with female spline halves 61 and 62 as shown in FIG. 1 and 16. The assembly of the female spline sub having been thus advanced by the application to the sub of integral reinforcing ring 74 as above described, the two halves as a unit are then screwed into the threads 59 so as to rigidly unite the two sub halves 61 and 62 as shown in FIG. 16.

The inner tubular element 27 of the tool 25 includes lower and intermediate thin walled sleeves 76 and 77 and a relatively heavy walled tubular male spline sub 78. The lower sleeve 76 makes a loose sliding fit downwardly within lower outer sub 28 and screws at its upper end, into a threaded socket provided therefor and recessed in the inner face of the lower end of intermediate sleeve 77. The exterior face of sleeve 76 is concentrically spaced from the bore 31 of outer tubular element 26 so as to slidably confine the sliding lower packing 32 therebetween. Formed externally on a lower end portion of intermediate sleeve 77 is an annular external head 79 having internal threads 80 into which is screwed an annular base 81 for a mechanical tripping device 82, said base 81 being formed integrally on the upper end of sleeve 76. Provided on said base 81 is an annular shoulder 83 and a cylindrical male threaded area 84 of reduced diameter just below said shoulder. A short distance axially below threaded area 84, the outer surface of annular base 81 is turned down to produce a tapering conical face 85. The lower small-diameter end of said tapered face 85 terminates by merging with the cylindrical external face of the downward balance of lower inner sleeve 76.

Spaced downwardly from the lower end of conical face 85 and snap-mounted in an annular radial slot formed externally in sleeve 76 is a snap-stop-ring 86.

Loosely fitting the cylindrical external face of the sleeve 76 between snap ring 86 and the lower end of conical face 85 and resting on said snap-stop-ring 86 is a spring mounting stop ring 87 which is peripherally vertically bored and counter bored at equally spaced circumferential intervals to mount four upwardly spring biased flat headed pins 88. Screwed into and vertically rising from ring 87 at a point equidistant from an adjacent pair of the spring biased pins 88 is a orienting pin 89.

Figure 17:
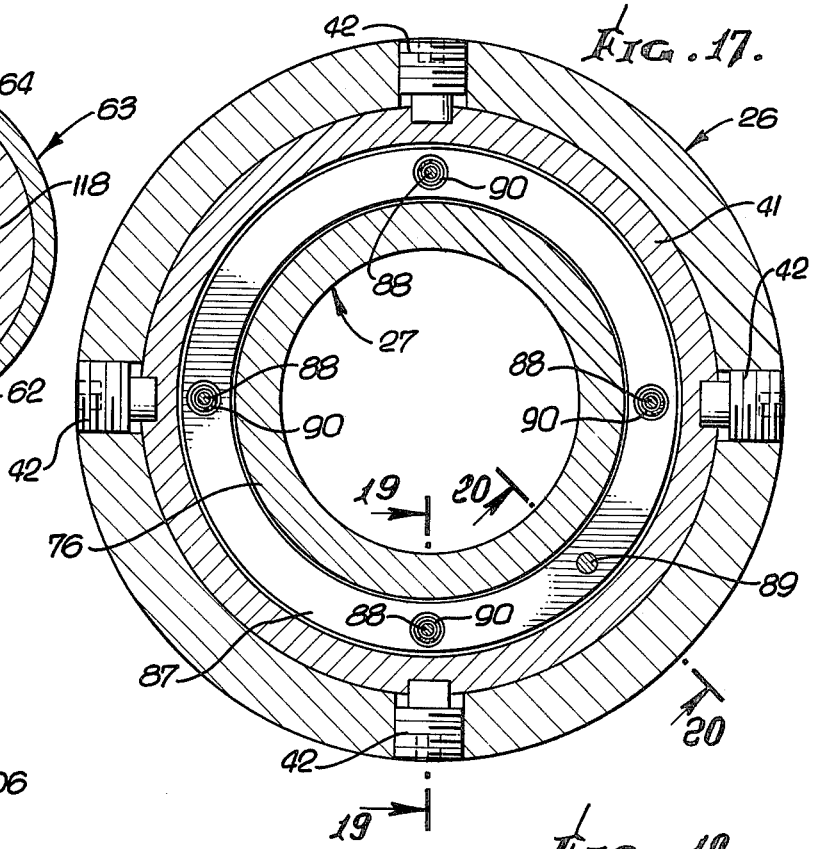
FIG. 17 is a full cross sectional view taken on the line 17—17 of FIG. 4 and shows the manner of fixedly mounting the down-blow jar trip ring on the tubular element, the spring means for yieldably spring biasing the tapering split ring upwardly on a downwardly externally tapering conical face formed on the inner tubular element of the jar and also shows the pin on said spring mounting ring which extends into the single radial split formed in the tapering split wedge ring of the invention which cooperates with said jar trip ring to regulate the amount of weight required to be imposed downwardly on said split wedge ring to trigger a downward jar blow by the tool.
Figure 21:
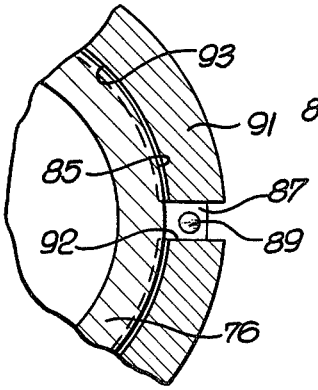
FIG. 21 is a detailed horizontal sectional view taken on the line 21—21 of FIG. 20 and illustrates the manner in which said pin in the spring mounting ring extends into the single radial slit in said jar wedge ring to prevent said rings rotating co-axially relative to each other.

Surrounding sleeve 76 within the vertical zone occupied by its conical tapering face 85, and normally resting on flat headed pins 88 and spring biased upwardly by the springs 90 surrounding said pins, is a split jar wedge ring 91. This ring has a single radial slot 92 extending vertically therethrough, the pin 89 extending into said slot (see FIGS. 17, 20 and 21) to prevent relative rotation between stop spring mounting ring 87 and wedge ring 91. One purpose of this is to assure continuous uniform functioning of the spring mounting pins 88 which would be interrupted if slot 92 should be turned so as to intersect one of said pins 88.

Split jar wedge ring 91 has a tapered bore 93 which slopes approximately 5° from the tool axis and loosely fits the 5° conical tapered face 85 formed on the tool sleeve 76.

Upper and lower end surfaces of split jar wedge ring 91 are formed in planes normal to the axis of the jar and the outer peripheral face of split jar wedge ring 91 preferably forms a cylinder concentric with the jar axis. Upper and lower outer corners where said cylinder and flat upper and lower end faces of said split wedge ring 91 intersect are bevelled at angles of 5° from the jar axis as indicated at 95.

Screwed on to the threads 84 and adjustably fixed thereon by a set screw 96 is a thin walled adjusting nut 97. Wedge ring 91 is constantly spring biased upwardly with sufficient force to engage the lower end of adjusting nut 97 no matter where this nut may be fixed by the setting of screw 96.

The adjusting nut 97 performs the function of an adjustable annular stop shoulder means which adjustably limits the outside diameter presented by the split wedge ring 91 to the jar trip ring 41 during the telescopic contraction of the jar 25 so as to provide just that degree of resistance needed during said contraction to build up the desired amount of compression applied by the drill string to the jar tool through the resistance offered by split wedge ring 91 to trip ring 41 as to produce a jar blow of the desired force when, through application of said force, the split wedge 91 is finally compelled to pass downward through the tripping ring 41 with the result that the pent up tension produced in the drill string by this resistance impels the juxtaposed impact faces 73 and 125 into a dynamic collision, as shown in FIGS. 11–15 inclusive.

A short distance upwardly from the upper end of tripping device base 81, the external annular head 79 of intermediate sleeve 77 is turned down to form a shoulder 100 and also form a cylindrical surface 101 on which an annular sleeve piston 102 may loosely fit. The shoulder 100 has a ground radial face which makes a tight sealing engagement with the lower end ground face of sleeve piston 102. The turned down cylindrical surface 101 terminates upwardly in threads 103 onto which is screwed a spring mounting sleeve 104, said sleeve being held against unscrewing by a spring stop ring 105 which is held in place by its own spring tension by snapping in place into an annular slot formed externally in sleeve 77.

Figure 18:
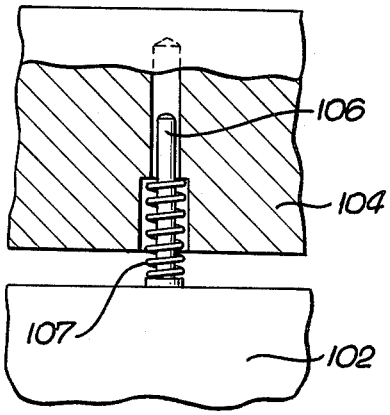
FIG. 18 is a detailed vertical enlarged sectional view taken on the line 18—18 of FIG. 3 and illustrates the means for spring biasing the hydraulic sleeve valve of the tool downwardly into a closed position which renders said valve effective to inhibit upward extension of the tool during an up-blow operation of the latter but leaves said valve free to open fully during the resetting contraction of said tool following said upward jar operation thereby preventing said sleeve valve inhibiting the immediately following functioning of the tool in a down-blow jarring operation.

Spring mounting ring 104 is bored and counter bored as shown in FIG. 18 to receive flat headed pins 106 and springs 107 at suitable circumferentially spaced points in said ring to apply spring biased pressure downwardly constantly against annular sleeve piston 102. The external cylindrical face of piston 102 is provided with a ground fit to make a tight sealing contact between said piston and internal cylinder 44 provided in the counter bore 40 of external sleeve element 26, whenever sleeve piston 102 is located in conjunction with said cylinder. The external periphery of sleeve piston 102 has a suitable annular recess for receiving therein an O-ring 108 for perfecting the sealing engagement of said sleeve piston with said cylinder.

The upper end portion of intermediate sleeve 77 is externally threaded at 109 and is provided with an external O-ring 110 to permit said sleeve to be screwed into and make a sealed connection with an externally enlarged lower annular head 115 provided on the lower end of male spline sub 78. This annular head makes a snug sliding fit with the smooth cylindrical bore 58 formed in stabilizer sleeve 48. The sub 78 has another externally thickened annular head 116 at its upper end, these heads being integrally united by a relatively thin walled central male spline section 117 which is milled out externally to provide a series of three male splines 118. The upper and outwardly enlarged head 116 is provided with tapered female threads 119 into which is screwed the lower pin section 120 of the drill string 121 upon which jar tool 25 is suspended.

Rigidly mounted as it is on the lower end of drill string 121, the male spline sub 78 properly has formed thereon impact faces 125 and 126 to function as hammers in the delivery of upward jar blows or downward jar blows in the operation of the jar 25. The annular impact face 125 is in vertically juxtaposed relation with the annular anvil impact face 73 provided on the upper end of the heavy cylindrical tubular body 64 of the spline assembly 63. The hammer impact face 126 is in vertical juxtaposed relation with the anvil impact face 70 provided on the lower end of spline assembly 63. The spline assembly 63 is thus on the receiving end of each jar blow struck by the jar and the male spline sub 78 is on the delivery end of each of such blows.

OPERATION

An annular chamber 130 is provided between the outer tubular element 26 and the inner tubular element 27 which is closed at its lower end by the sliding packer 32 and at its upper end by the fixed packer 55. One or more plugs 47 are provided for use in the conventional manner for filling chamber 130 with operating fluid which is generally a light lubricating oil and for withdrawing the air from this chamber at the time the fluid is delivered thereto. When the tool 25 is in its normal starting position with the parts as shown in FIGS. 1–5 inclusive, the entire chamber 130 is filled with operating liquid. As seen in FIG. 3, the cylinder 44 is out of conjunction at this time with the piston 102. Lifting the drill string 121 from this position to bring cylinder 44 into conunction with the piston 102 divides the hydraulic chamber 130 into a high pressure upper section and a low pressure lower section. The lower section always remains a low pressure area because of the freedom of the sliding packer 32 to shift vertically in response to any change in the relative pressures below and above said packer so that pressure in the lower section of the hydraulic chamber 130 is always substantially equal to the pressure of the ambient well fluid in which the tool 25 is operating. The outer tubular element 26 being connected through the drill collar 30 to the fish which is stuck in the well, elevation of the piston 102 brings this into conjunction with the cylinder 44, and this is achieved by the driller raising the drill string 121 to tension the same.

Figures 6, 7, 8, 9, 10:
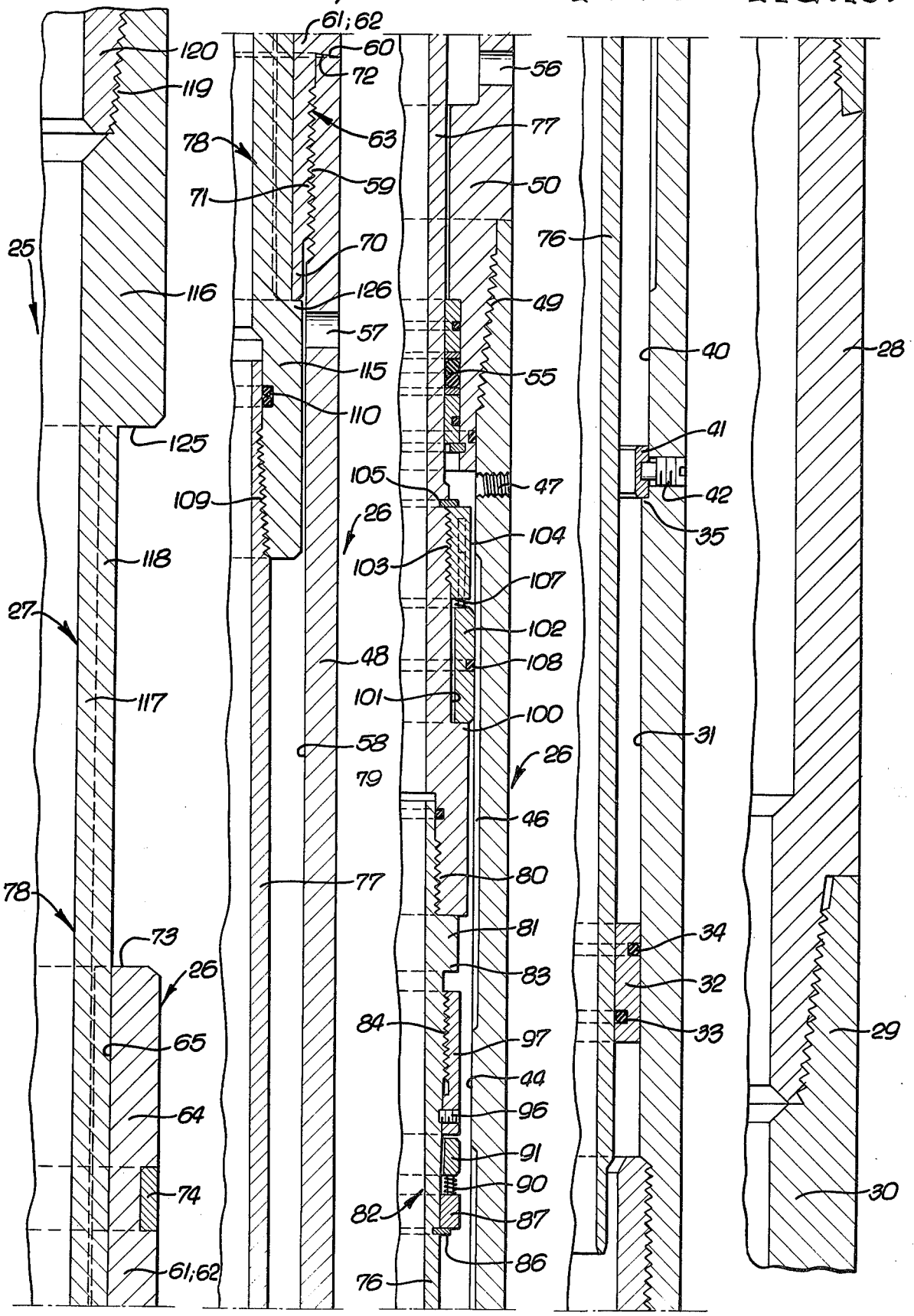
FIGS. 6 to 10 inclusive are a set of similar views illustrating the moment of impact in an upward jarring operation.

With the parts of the tool 25 positioned as shown in FIGS. 1–5 inclusive, the driller has two options open to him in operating said tool. The first of these is to lift on the drill string 121 to bring the sleeve piston 102 into conjunction with the cylinder 44 which retards escape of the operating liquid in the upper high pressure section of the chamber 130, thus giving an opportunity to build up a relatively high tension strain on the drill string 121 during the travel of the piston 102 upwardly past the cylinder 44 and resulting in an upward snap action jarring operation when the hammer impact face 126 strikes the anvil impact face 70 as shown in FIG. 7.

The location of the respective elements of the jar 25 at the moment of delivery of an upward snap action jarring blow by the tool 25 are illustrated in FIGS. 6–10 inclusive. Immediately following the delivery of this upward blow in the operation above described of the jar 25, the driller lowers the drill string 121 to promptly return the parts of the jar 25 to their composite position shown in FIGS. 1–5 inclusive. This jar has the facility of providing a clear indication of the arrival of the parts of the jar in this position by the fact that as this position is reached, the split jar wedge ring 91 in its normally expanded condition has just been lowered with a downward movement of the inner tubular element 27 so as to come into contact with the upper end of tripping ring 41 which, it is to be remembered, has a bore which is smaller than the outside diameter of the unconstrained split wedge ring 91 thereby imposing a substantial resistance to further downward movement of the drill string 121 beyond this point.

Figures 11, 12, 13, 14, 15:
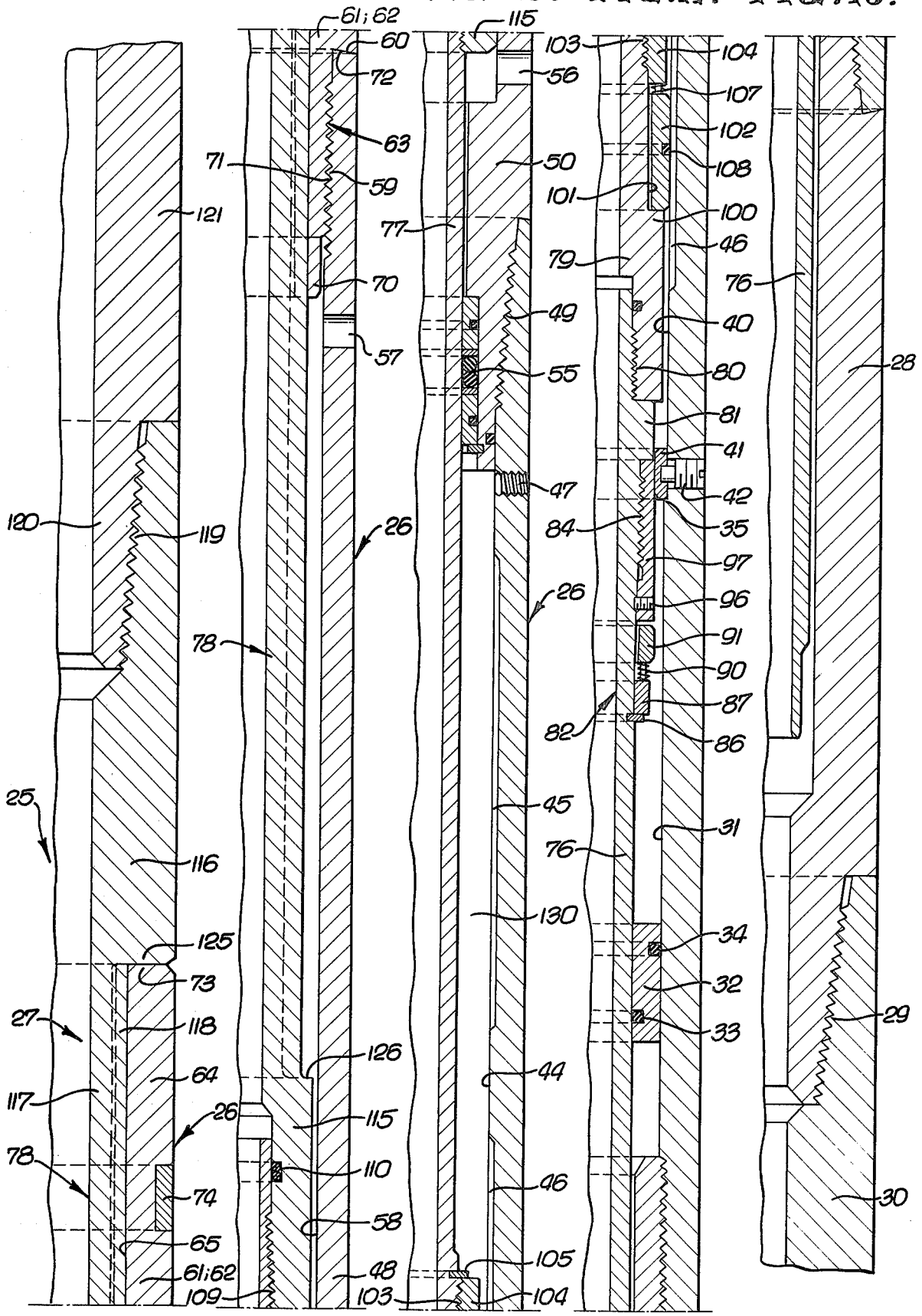
FIGS. 11 to 15 inclusive are a set of similar views illustrating the moment of impact in a downward jarring operation.
Figure 19:
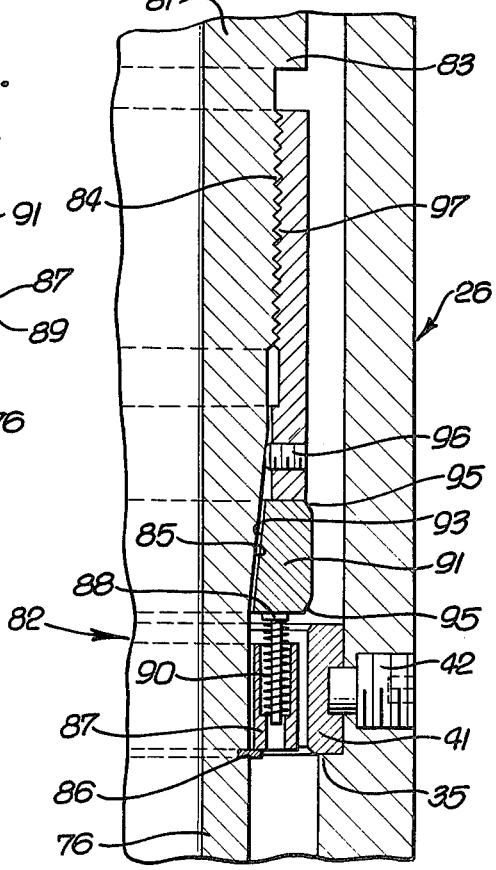
FIG. 19 is an enlarged detailed vertical sectional view taken on the line 19—19 of FIG. 17 and illustrates the spring biased mounting of the single radial split jar wedge ring and the mechanism provided for adjusting the position of this ring so as to accurately control the vertical force required to be imposed downwardly on the tool by the drill string in order to initiate and trigger its striking a heavy downward blow by the tool of the invention.
Figure 20:
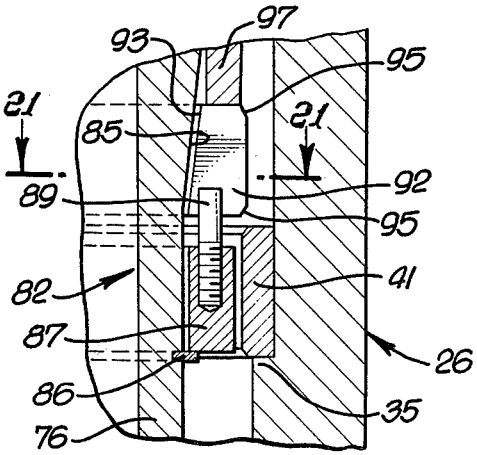
FIG. 20 is a vertical detailed sectional view taken on the line 20—20 of FIG. 17 and illustrating how the pin mounted on the spring supporting ring for spring biasing the jar wedge ring upwardly, extends into the single radial split provided in said wedge ring and thus prevents relative co-axial rotation between said jar wedge ring and said spring mounting ring.

When lifting on the drill string 121 to reset the jar tool 25 as seen in FIG. 19, for effecting a second downblow therewith, the rising of the lower thin walled sleeve 76 carries the split wedge ring 91 upwardly, yieldably supported on springs 90. Depending on the adjustment of the thin-walled stop nut 97, there may be a slight gap at this moment between the adjacent ends of split wedge ring 91 and stop nut 97, as shown in FIG. 14, or these two elements may be spring biased vertically together as shown in FIGS. 19 and 20.

Supposing the latter to be the case, the lifting on the lower thin-walled sleeve 76 to reset the down-jar mechanical tripping device 82 starts at the point of maximum extension of said mechanism shown in FIG. 14 with the split jar wedge ring 91 extending down well below the level of the stationary tripping ring 41, and with the latter being lodged, as it is, securely on the annular shoulder 35 provided on the outer tubular tool element 26.

Both in resetting the mechanical tripping device 82 to prepare to strike another down-jar blow and in triggering the jar to actually strike that blow, it is necessary for the split jar wedge ring 91 to be forced axially entirely through the tripping ring 41. The jar is designed whereby the first mentioned penetration of the tripping ring is accomplished with a minimum of resistance. The second such penetration which is required in actually striking a down-jar blow, is deliberately designed to build up a very high axial resistance and particularly one which can be variably adjustable and thus enable a driller to meet precisely the demands made on a jar tool as these vary from job to job.

It is to be remembered that, while split wedge ring 91, when unconstrained, has an OD which exceeds the ID of tripping ring 41, that excess is only a very small margin and the degree of freedom gained by the concurrent tapers 85 and 93 in the axial mounting of split jar ring 91 and its provision with an axial slot 92 affords said split wedge ring a substantial scope for contracting its outside diameter.

Approaching the tripping ring 41 co-axially from beneath in the operation for resetting the mechanical jar tripping device 82, the upper 5° bevelled peripheral lip 95 on the split jar ring 91 overlaps the similar 5° annular, bevelled, internal lip formed within the lower end of stationary tripping ring 41.

The axial force components generated by this collision initially collapses the springs 90, picking up the split jar wedge ring 91 as a passenger sitting on the spring mount and ring stop 87. Thus backed up by direct contact with the rising ring stop 87, the jar split wedge ring 91 is now ramroded entirely through the tripping ring 41, following which, the springs 90 speedily rebias the split wedge ring 91 back into contact with the bottom end of adjustment nut 97, and assist it to resume its original expanded dimensions as the jar parts arrive at their neutral middle position shown in FIGS. 1–5 and 19.

The reason for mechanism 82 offering such a small axial resistance to the performance of the resetting operation, just described, is that the large diameter end of the tapered face 85 on which split wedge ring 91 is loosely mounted, is disposed upwardly towards the tripping ring 41. Thus, the initial upward engagement of the split ring 91 with tripping ring 41 halts the upward movement of split ring 91 until it is caught up with by the spring mounting stop ring 87. At this point of time the conical split ring seat 85 has risen to substantially increase the radial gap between said seat and the conical bore 93 of split wedge ring 91.

The simultaneous impingement at this moment on the split wedge ring 91 by the tripping ring 41 from above and by the stop ring 87 from beneath, collapses the split wedge ring 91 into the slightly smaller space afforded by the bevelled bore of tripping ring 41 and propells the collapsed wedge ring 91 upwardly axially through and out of said tripping ring as shown in FIG. 19.

The adjustable nut 97 and set screw 96 are provided in the mechanical jar tripping device 82 to enable the operator to control the amount of resistance released by the jar incidental to its delivering a down-jar blow. The higher the stop nut 97 is set on threads 84 by the set screw 96, just that much greater a resistance will be required to force split wedge ring 91 downwardly through tripping ring 41 in performing a down-jar blow.

The character of the down-blow struck by the jar tool 25 varies greatly in accordance with the adjustments provided for in the mechanical tripping device 82. The resetting of the tool after striking a down-blow however, is not modified in any way by these adjustments which are solely to govern the resistance imposed by the tool in striking a down-blow.

The stop nut 97 is usually set at a level such as shown in FIG. 19 so that, when a down-jar blow is being struck and the split wedge ring 91 is being clamped vertically between the tripping ring 41 and the nut 97, the ring 91 is constricted to fit the tapered sleeve face 85 and to produce an internally supported outside diameter on split wedge ring 91 which requires a force to be applied to downwardly penetrate ring 41 with ring 91 which is of a magnitude similar to that employed commonly in permanently assembling machine parts with a drive fit.

The outside diameter of stop nut 97 allows it to pass freely through tripping ring 41 and thus enable it to apply the needed continuous down thrust to split wedge ring 91 until the latter is discharged downward from tripping ring 41 producing a down-jarring blow on the fish.

We claim:

1. In a mechanical jar tool, the combination of:

inner and outer telescopically related tubular elements;

means for connecting one of said elements to a drill string;

means for connecting the other element to an object to be jarred referred to herein as a "fish", telescopically overlapping portions of said elements providing an annular chamber;

a pair of impact shoulders being provided on said respective elements to form impact faces which are brought into collision to limit telescopic movement between said elements in one of the two directions effecting respectively extension or contraction of said tool;

a male threaded area formed externally on said inner element within said chamber;

a tapered external conical face formed on said inner element starting at one end of said threaded area and decreasing in radius as said conical face extends axially away from said threaded area;

a thin walled adjusting nut screwed onto said threaded area and freely adjustable lengthwise thereon, said nut having locking means for fixing said nut in a selected position on said inner element;

a jar wedge ring internally tapered to conform to and loosely fit said tapered face of said inner element and having at least one radial split formed in said jar wedge ring, the periphery of said jar wedge ring being approximately cylindrical with outer corner edges bevelled;

means for spring biasing said jar wedge ring axially towards and into conctact with said adjusting nut and halting axial shifting of said jar wedge ring more than a short distance away from said adjusting nut; and a jar trip ring mounted fixedly on the inner face of said outer element, the inner face of said jar trip ring being cylindrical with bevelled inner corner edges and slightly less in inside diameter than the outside diameter of said split bevelled jar wedge ring;

said nut being locked in such a position that when said telescopic movement shifts said jar wedge ring axially against said trip ring and constricts the inside face of the wedge ring into conformity with said tapered element face while forcing said wedge ring also against said adjusting nut, the periphery of the wedge ring will be just enough larger than the inside diameter of the jar trip ring to require application of a predetermined desireable heavy pressure through said bevelled wedge ring to said bevelled trip ring to force the bevelled wedge ring through the trip ring and accomplish a jar blow being struck by bringing said impact faces into a violent collision.

2. A combination as recited in claim 1 wherein said jar tool is reset following said jarring operation by a telescopic movement between said elements in a reverse direction to that which delivered said jar blow; and wherein contact of said jar wedge ring with said jar trip ring during the resetting of said jar shifts said wedge ring axially away from contact with said adjusting nut and against said biasing means thereby substantially increasing the radial annular clearance between said tapered element face and the tapered bore of said wedge ring and thereby facilitating the ready constriction of said wedge ring by the axial obstructive pressure interposed thereagainst by said jar trip ring with the result that a relatively small axial force thus applied to said jar wedge ring constricts this and allows said jar wedge ring to readily pass through said jar trip ring and said reverse telescopic movement thus continuing to complete the resetting of said tool.

3. In a deep well jar tool, the combination of:

inner and outer telescopically related tubular elements;

means for connecting one of said elements to a drill string;

means for connecting the other element to an object to be jarred, referred to herein as a "fish", telescopically overlapping portions of said elements providing an annular chamber;

a pair of impact shoulders being provided on said respective elements to form impact focus which are brought into collision to limit telescopic movement between said elements in one of the two directions effecting respectively extension or contraction of said tool;

a tapered conical face formed externally on said inner element within said chamber, an annular stop shoulder means being formed on said inner element, said shoulder means extending radially outwardly from said element at the thicker of the two ends of said tapered conical face;

a jar wedge ring internally tapered to conform to and loosely fit said tapered face of said inner element and having at least one radial split formed axially in said wedge ring, the peripheral surface of said split jar wedge ring being approximately cylindrical with edges which are bevelled;

stop ring means encircling and fixed upon said inner element in axially spaced relation with said annular stop shoulder means to give a substantial degree of freedom for axial movement of said jar wedge ring on said tapered conical face of said inner element;

a jar trip ring rigidly mounted on the inner face of said outer element, the inner face of said trip being approximately cylindrical with bevelled corner edges, and slightly less in diameter than the outside diameter of said jar wedge ring when unconstrained;

spring means for biasing said jar wedge ring axially towards and into contact with said annular stop shoulder means but yielding to opposition offered by said jar trip ring in the resetting of said tool to permit said jar wedge ring to freely move against the pressure of said spring means and in to contact with said stop ring means and be thus reduced in diameter and forced through said jar trip ring;

said annular stop shoulder means formed on said inner element being so positioned that, when said telescopic movement shifts said jar wedge ring axially against said trip ring and constricts the inside tapered face of said wedge ring into conformity with said tapered element face while forcing said wedge ring at the same time against said annular stop shoulder means, the periphery of the wedge ring will be just enough larger than the inside diameter of the jar trip ring to require application of a predetermined high axial pressure to force said jar wedge ring through said jar trip ring and thus accomplish a jar blow by bringing said impact faces into violent collision.

4. A combination as recited in claim 3 wherein said spring means comprise spring biased axially parallel plungers arranged in circumferentially spaced positions on said stop ring means, said plungers engaging said jar wedge ring to spring bias said jar wedge ring into constant contact with said inner element radial annular stop shoulder means; and a pin extending axially from said stop ring and entering the split provided in said jar wedge ring to prevent relative co-axial rotation between said jar wedge ring and said stop ring means.

5. A combination as recited in claim 3 wherein said annular stop shoulder means is axially adjustable on said inner element to vary the external diameter of said split jar wedge ring when said split jar wedge ring is simultaneously co-axially pressed endwise against said stop shoulder means and constricted into annular contact with said tapered conical face on said inner element, whereby said split jar wedge ring may be forced axially through said fixed jar trip ring.

6. A combination as recited in claim 5 wherein said annular stop shoulder means comprises a thin walled tubular, internally threaded nut, and wherein said inner element is provided with male threads located at the larger end of said tapered conical face, said nut being screwed onto said threads, and set screw means for adjustably locking said nut in a given lengthwise position on said threads.

* * * * *